United States Patent [19]

Ward

[11] 4,271,748

[45] Jun. 9, 1981

[54] SHORTING AND RADIATION PROTECTION DEVICE FOR ROCKET

[75] Inventor: Frederick D. Ward, St. Foy, Canada

[73] Assignee: Her Majesty the Queen in right of Canada, as represented by the Minister of National Defence, Ottawa, Canada

[21] Appl. No.: 22,107

[22] Filed: Mar. 20, 1979

[30] Foreign Application Priority Data

Jul. 6, 1978 [CA] Canada ..... 306896

[51] Int. Cl.[3] ..... F41F 3/04

[52] U.S. Cl. ..... 89/1.814; 89/1.807; 89/1.812

[58] Field of Search ..... 89/1.814, 1.813, 1.806, 89/1.807, 1.812

[56] References Cited

U.S. PATENT DOCUMENTS

| | | | |
|---|---|---|---|
| 3,504,593 | 4/1970 | Ricks et al. | 89/1.807 |
| 3,513,749 | 5/1970 | Magnant | 89/1.807 |
| 3,721,155 | 3/1973 | Stauff et al. | 89/1.814 X |
| 4,007,660 | 2/1977 | Smith | 89/1.814 X |

*Primary Examiner*—David H. Brown

*Attorney, Agent, or Firm*—Larson, Taylor and Hinds

[57] ABSTRACT

The invention disclosed is a safety device for preventing premature firing of a rocket due to radiation directed at the aft-end of the rocket. The safety device which is attached to the aft-end of a rocket comprises an electrical contact ring which is electrically connectable to the rocket igniter, a shielding means, also electrically connected to the igniter, for shielding the igniter and firing circuit from electromagnetic radiation, insulating means between the electrical contact ring and shielding means and electrical switch means connected between the shielding means and the electrical contact ring.

4 Claims, 3 Drawing Figures

SHORTING AND RADIATION PROTECTION DEVICE FOR ROCKET

BACKGROUND OF THE INVENTION

This invention relates to rocket retention and ignition assemblies for rocket launchers, and in particular to an igniter safety device for use in conjunction therewith.

DESCRIPTION OF THE PRIOR ART

A number of prior retention systems make use of detent or latch mechanisms which protrude into the launcher tube through holes in the side of the tube wall to engage the rocket and hold it in position. Such systems are unsatisfactory in that the necessary holes or slots in the launch tube walls become eroded by the rocket exhaust. Moreover such detents or latch mechanisms protruding into the launch tube interfere with the reproducibility of the rocket release loads.

Certain more recent systems have eliminated the aforementioned disadvantages of detents or latch mechanisms by securing the rocket in position in the launch tube by means of a shear pin engaged in a shear pin ring which is mechanically secured to the rocket launcher at the base of the rocket launcher tube so that the shearing force of the shear pin or shear pins determine the rocket release load. Such systems, however, have introduced the additional disadvantage of necessitating individual correct orientation of the rockets and/or electrical connects between the rockets and the launcher, thus increasing both the loading time and the incidence of non-functioning or mal-functioning of the rocket ignition systems.

A rocket retention and ignition assembly which achieves this result is described in applicant's Canadian Patent No. 1,026,979 and provides a simple positive means for securing rockets in a loaded position ready for firing and for igniting the rockets which does not require any particular orientation of the rockets within the launching tubes or of any of the individual electrical connections for the rocket ignition system.

More specifically, in the rocket retention and ignition assembly of the aforementioned patent the rockets are simply loaded into the rear end of each tube of the rocket launcher through a loading hole for each tube which permits passage of the rocket therethrough but which is too small to permit passage of a retention member, such as a shear pin ring, attached to the rear end of each rocket. First support means such as a rigid plate or bulkhead forming this loading hole thus engage the shear pin ring of each rocket and prevent any forward displacement of the rocket in its respective launch tube. A second support means such as a rigid plate is then connected to the rear of the rocket launcher to prevent rearward displacement of the rockets in their respective tubes. This second support means has an opening formed therein for each rocket to be secured, each opening being located at the rear end of a rocket thus allowing for the exit of rocket exhaust for as long as the rocket remains in the launch tube after ignition.

None of the prior art systems above includes provision for ensuring that a rocket projectile carried on an aircraft is completely safe up to the moment of firing. The safe period must include the time spent in munition stores, the time during which the rocket is transported to the aircraft and mounted, and the time during which it is carried on the aircraft. Additionally, if the rocket is not fired, there must be no hazard involved in unloading and returning it to stores. The hazard in question is the possibility of premature operation of the electric igniter, which could be caused by inadvertent exposure to electromagnetic radiation. Maximum safety can be assured only if the igniter is "shorted" until the moment of firing, and if that part of the circuit between the igniter and the short is shielded effectively from radiation.

A typical contemporary means of shorting and shielding is to place a clip-on metal cap over the tail of the rocket. This cap is so arranged that it short circuits the external contacts of the igniter.

Although the rocket may be loaded with this cap in place, a disadvantage of this method is that it must be removed before connection is made into the firing circuit by a special bolt-on retaining plate. For a brief interval the igniter is neither shorted nor shielded, and after connection there is no protection against radiation from the rear. When as is usual there are a number of rockets in a "pod" sharing a common connecting plate, this unsafe interval can be appreciable. A similar hazard exists if the rockets are unloaded, when the safety caps must be replaced, and sufficient caps must be in the hands of the armourers.

It is therefore an object of the invention to provide a safety device for use in conjunction with rocket retention and ignition assemblies for rocket launchers which is simple, cheap, and which itself presents minimal danger to the aircraft structure if ejected as debris when the rocket is fired.

The ignition safety device of the present invention is typically employed in conjunction with the same basic ignition and retention assembly as described in Canadian Patent No. 1,026,979. However, the electrical circuitry is modified slightly to accommodate the safety device as will be apparent hereinafter.

SUMMARY OF THE INVENTION

According to the invention, a rocket igniter safety device for use in conjunction with a rocket retention and ignition assembly for a rocket launcher and for a rocket is provided, said rocket including an igniter and a retention member outwardly extending from and circumscribing the rocket body adjacent the rear end of said rocket, said retention member disconnecting from the remainder of said rocket when said rocket is fired, said assembly comprising first support means for engaging said retention member when said rocket is placed in a firing position in said rocket launcher and preventing forward displacement of said retention member from the firing position, said first support means having a loading hole formed therein to permit loading of said rocket therethrough into said rocket launcher, said hole being too small to permit passage of said retention member therethrough, second support means adapted to be detachably fixed to said first support means and adapted for engaging said retention member when said rocket is in said firing position and preventing rearward displacement of said retention member from the firing position, said second support means being removable from said first support means to permit removal of a spent retention member and loading of a rocket, said second support means having an opening formed therein, said opening being located at said rear end when said second support means engages said retention member, and a first electrical contact means attached to said second support means, said electrical contact means being electrically connected to an electrical firing means, said safety device comprising (a) a second electrical contact means electrically connected to said igniter by means of an insulated electrical conductor to define a first part of an electrical circuit, (b) shielding means for shielding said electrical circuit from electromagnetic radiation, said shielding means being electrically connected to said igniter by means of an insulated electrical conductor, and to ground, to define a second part of said electrical circuit, (c) insulating means between said second electrical contact means and said shielding means for electrically insulating said electrical contact means from said shielding means, and (d) electrical switch means between said shielding means and said second electrical contact means for shorting said electrical circuit by grounding said igniter when said switch means is closed, such that in operation, when said rocket is placed in the firing position, actuating means associated with said second support means simultaneously opens said switch means and effects electrical contact between said first and second electrical contact means to complete the electrical circuit between said igniter and said electrical firing means, wherein said safety device is adapted to be fastened to said retention member.

BRIEF DESCRIPTON OF THE DRAWINGS

In the drawings which serve to illustrate the preferred embodiments of the invention, FIG. 1 is a side elevation in section of the rear part of a rocket including the retention assembly and ignition safety device of the invention in the grounded mode, FIG. 2 is a plan view of part of the rocket retention assembly, and FIG. 3 is a side elevation in section illustrating the operation of the ignition-safety device according to the invention in the firing position.

DETAILED DESCRIPTION OF PREFERRED EMBODIMENT

Figure 1:
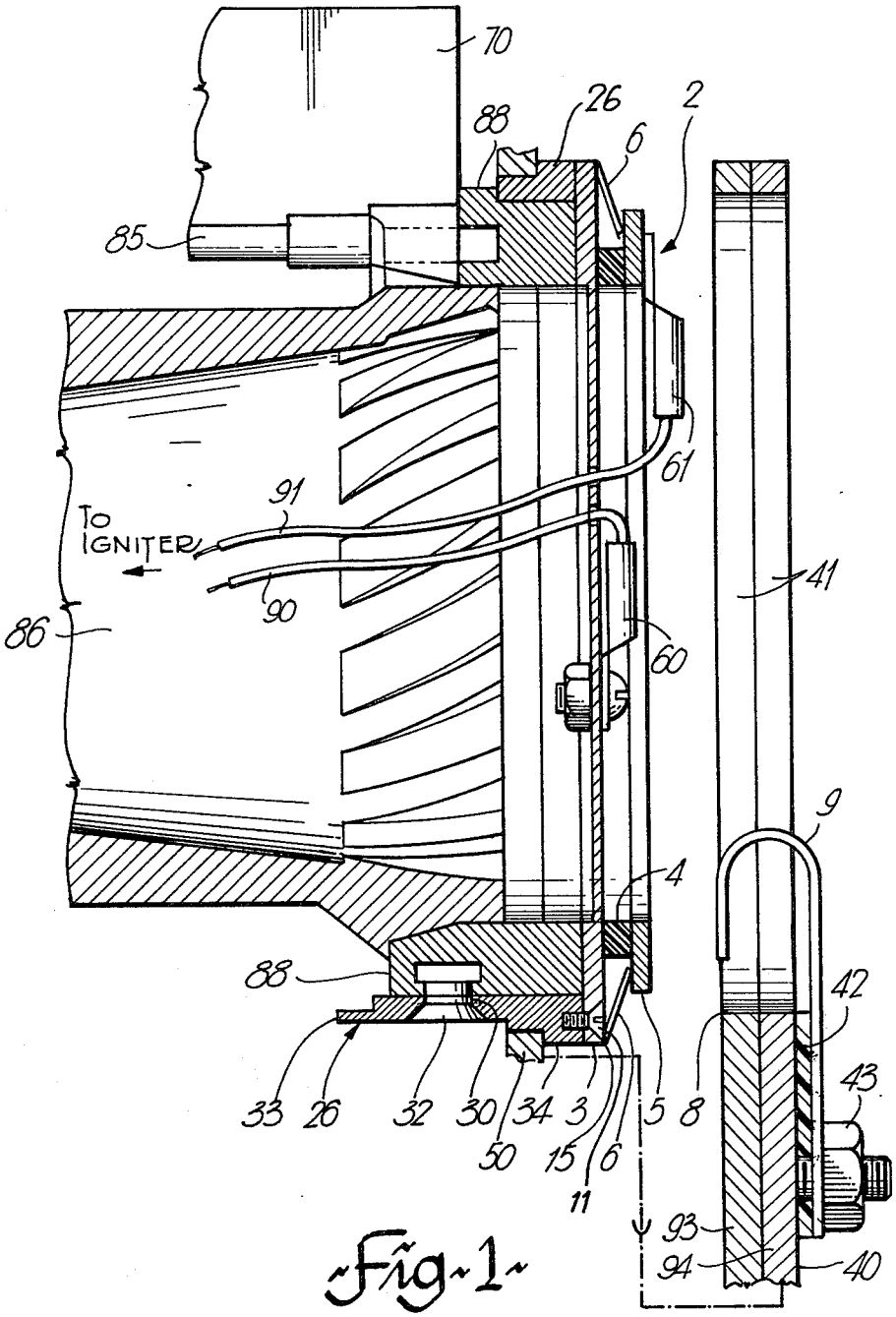
Figure 2:
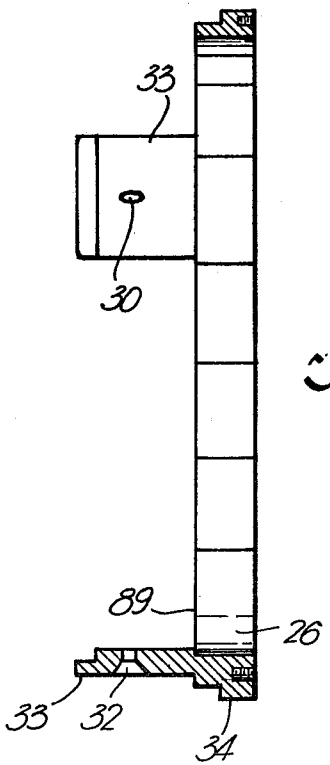

In the drawings, the rear portion of a rocket nozzle 86 is illustrated in conjunction with a rocket retention assembly. Specifically, a retention member 26 is connected to the rear of the nozzle assembly by means of one or more shear pins 32. As can be seen from FIG. 1, the retention member 26 extends outwardly from the side of the rear end of the rocket and preferably comprises a shear ring extending about the periphery of the rear end. Three short lugs 33 extend from the shear ring towards the front end of the rocket, each lug being spaced approximately 120° from the other lugs relative to the center axis of the shear ring. Each lug 33 has its own shear pin 32 which is accommodated in a hole 30 formed in the lug. A lug detent ring 88 extends about the exterior surface of the nozzle 86 and each pin 32 extends into a hole formed in the side of nozzle 86. The lug detent ring 88 is used to support the support pins 85 of the fins 70. This ring 88 has three recesses formed about its exterior to accommodate the three lugs 33 of the shear ring.

A radially outwardly extending annular flange 34 formed on the shear ring 26 has an external diameter which does not permit passage of this flange through the holes formed in the first support means 50. In other words, in the firing position of the rocket, the edge of each hole engages the front surface of the flange 34 so the rocket is effectively prevented from moving further forward in the launch tube. As stated, the use of such a shear ring and shear pins is known in this art. The shear ring disconnects from the remainder of the rocket when the rocket is fired by means of the shearing of the shear pins. The force required to shear the shear pins can be accurately predetermined and therefore rocket release conditions can be accurately preset with the use of such shear pins and are therefore reproducible.

Second support means 40 is detachably attached to the rear of the first support means 50 as indicated in chain lines in FIG. 1, in order to complete the support means for the rockets in the launch tubes. The second support means engages the retention members 26 of the rockets when they are in their firing positions and thereby prevents rearward displacement of the retention members from the firing position. As clearly shown in FIGS. 1 and 3, the second support means 40 preferably consists of front and rear plate members 93 and 94, respectively, these plate members being rigidly connected together by six rivets (not shown) or other suitable fastening means. Each of these plate members 93 and 94 is substantially circular and has six openings formed therein, one of which, denoted 41, is shown in FIG. 1. Each of these identical openings is circular and each opening in each plate is coaxial with an opening in the other plate member. Also, each opening 41 is arranged so as to be located at the rear end of a rocket when the second support means 40 is connected to the first support means 50. When connected, the second support means is maintained at an equal distance from the first support means at all locations. Each opening 41 has a diameter smaller than the external diameter of the flange 34 of the retention member.

The novel safety device is seen to comprise an assembly 2 fixed to the retention member 26 by means of screws 11 or the like. The assembly 2 includes a shielding means in the form of an electrically conducting metal member 3; an insulating means in the form of a washer 4, conveniently of hard rubber or plastic; an electrical contact means 5, conveniently in the form of an electrically conducting metal ring; and a switch means, conveniently an electrically conducting spring metal ring member or spring-ring member 6 e.g. a generally conical brass ring. The assembly being held together by means of a suitable adhesive e.g. epoxy cement, the spring-ring member 6 being held in a groove formed between the contact ring 5 and the shielding member 3.

The shielding member 3 comprises a heavy metal outer ring and a thinner radially-coined metal disc. Two holes are provided in the disc through which insulated electrical conductors 90 and 91 pass. Conductor 90 is electrically connected at one end to the shielding member 3, conveniently by crimping means 60; and conductor 91 is electrically connected at one end to the electrical contact ring 5 by crimping means 61. The other ends of conductors 90 and 91 are electrically connected to the igniter (not shown).

In the embodiment shown in FIG. 1, the igniter is grounded. In this grounded or pre-firing position, a first edge 15 of the spring-ring member 6 is in contact with the shielding member 3 and the second edge 16 of the spring-ring member 6 is in contact with the electrical contact ring 5. Moreover, the conductors 90 and 91 and the igniter are shielded from electromagnetic energy directed at the rear of the rocket.

Figure 3:
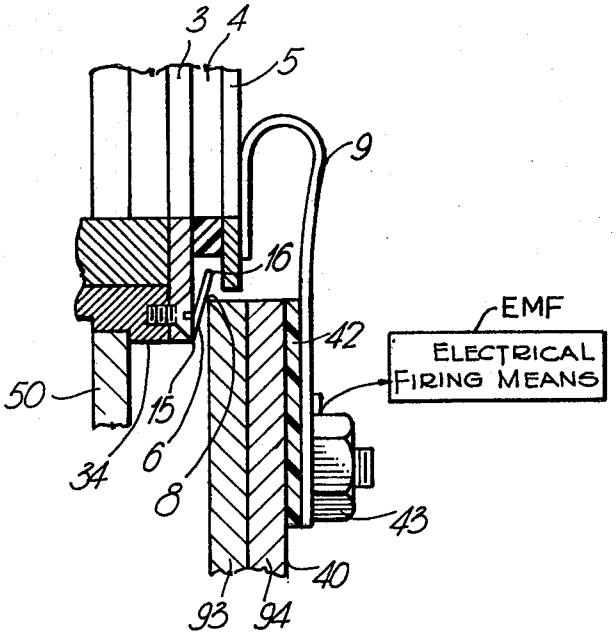

With the rocket in the firing position in the launcher i.e. with flange 34 preventing forward movement by butting against the first support member 50, the second support member 40 is fastened to the launcher and to the first support member 50. Rearward movement of the rocket is prevented by the second support member 40. As the second support member 40 is positioned for fastening to the first support member, its leading edge 8 engages the spring-ring member 6 and effectively opens the switch, as seen in FIG. 3. At the same time, electrical contact, conveniently in the form of an electrically conducting metal spring member 9, contacts electrical contact ring 5.

The leading edge 8 and spring member 9 thus act as an actuating means for simultaneously opening the switch means formed by spring-ring member 6 and completing an electrical circuit between the igniter and an electrical firing means (not shown). The electrical contact formed by spring 9 is thus electrically connected to an electrical firing means (not shown), such that in the firing position illustrated in FIG. 3, the igniter is electrically connected to the electrical firing means. The spring member 9 is electrically insulated from the second support member 40 by means of an insulator 42 e.g. a strip of rubber. The spring member 9 and insulator 42 are fastened to the second support member 40 e.g. by means of a nut and bolt arrangement 43.

In operation, a rocket is inserted into a launcher through a hole in the first support member 50, further forward movement being prevented by flange 34 which butts against the first support member 50. At this point, the rocket and attached ignition safety device 2 are as illustrated in FIG. 1, that is, with the igniter grounded and shielded from electromagnetic radiation, which could otherwise detonate the igniter and accidentally fire the rocket. At this point, the second support member 40 is fastened to the launcher, brought into the firing position and is attached to the first support member 50 as shown in FIG. 3, to prevent backward movement of the rocket. Upon positioning of the second support member 40, the leading edge 8 of the support member 40 opens the switch means formed by spring-ring member 6 of the safety device by pressing the spring-ring member 6 away from the contact ring 5, the electrical contact 9 simultaneously contacting the metal contact ring 5 of the safety device, as illustrated in FIG. 3. The electrical contact formed by spring 9 is electrically connected to an electrical firing means EFM and an electrical circuit between the firing means and the igniter of the rocket is now complete. Since the electrical contact member 5 is in the form of a ring, no specific rotational orientation of the rocket is required upon insertion in the launcher. The rocket is now ready for firing. When the rocket is fired, the centre of the shielding disc 3 petals out to permit free flow of gases and to minimize debris. The pins 32 shear off when the rocket thrust develops to a certain level, thereby releasing the rocket and nozzle assembly from the shear ring 26 for launch.

An unfired rocket may be unloaded by removing the second support member 40. The igniter is thus grounded immediately by reverse biasing action of the spring-ring member 6.

It will be apparent to those skilled in the art that the invention may be embodied in forms other than those specifically described herein without departing from the spirit or central characteristics of the invention. Accordingly, the embodiments illustrated are to be considered as illustrative and by no means restrictive.

I claim:

1. A rocket igniter safety device for use in conjunction with a rocket retention and ignition assembly for a rocket launcher, and for a rocket including an igniter and a retention member outwardly extending from and circumscribing the rocket body adjacent the rear end of said rocket, said retention member disconnecting from the remainder of said rocket when said rocket is fired, said assembly comprising first support means for engaging said retention member when said rocket is placed in a firing position in said rocket launcher and preventing forward displacement of said retention member from the firing position, said first support means having a loading hole formed therein to permit loading of said rocket therethrough into said rocket launcher, said hole being too small to permit passage of said retention member therethrough, second support means adapted to be detachably fixed to said first support means and adapted for engaging said retention member when said rocket is in said firing position and preventing rearward displacement of said retention member from the firing position, said second support means being removable from said first support means to permit removal of a spent retention member and loading of a rocket, said second support means having an opening formed therein, said opening being located at said rear end when said second support means engages said retention member, and a first electrical contact means attached to said second support means, said electrical contact means being electrically connected to an electrical firing means, said safety device comprising (a) a second electrical contact means electrically connected to said igniter by means of an insulated electrical conductor to define a first part of an electrical circuit, (b) shielding means for shielding said electrical circuit from electromagnetic radiation, said shield means being electrically connected to said igniter by means of an insulated electrical conductor, and to ground, to define a second part of said electrical circuit, (c) insulating means between said second electrical contact means and said shielding means for electrically insulating said electrical contact means from said shielding means, (d) electrical switch means between said shielding means and said second electrical contact means for shorting said electrical circuit by grounding said igniter when said switch means is closed, and (e) actuating means for simultaneously opening said switch means and effecting electrical contact between said first and second electrical contact means to complete the electrical circuit between said igniter and said electrical firing means, when said rocket is placed in the firing position, wherein said safety device is adapted to be fastened to said retention member.

2. A rocket igniter safety device according to claim 1, wherein said second electrical contact means is in the form of a metal ring such that no specific rotational orientation of the rocket in the launcher is required to complete the electrical circuit between the igniter and the electrical firing means.

3. A rocket igniter safety device according to claim 2, wherein the shielding means is in the form of a metal ring defining a central opening therein, and a coined thinner metal disc in said opening, arranged such that upon firing the disc petals out to permit free flow of gases, wherein said shielding means is adapted to be fastened to said retention member.

4. A rocket igniter safety device according to claim 3, wherein said electrical switch means is in the form of a flat ring member of spring metal having first and second edges, one of said edges being in contact with said shielding ring and the other edge being in contact with said electrical contact ring to ground said igniter defining a pre-firing position, wherein said spring member is adapted to be moved out of contact with the electrical contact ring by said actuating means to define the firing position, the spring member being biased oppositely to the direction of launch of the rocket such that upon removal of an unfired rocket, contact between the spring member and the electrical contact ring is re-established.

* * * * *